US010756415B2

(12) United States Patent
Wu et al.

(10) Patent No.: US 10,756,415 B2
(45) Date of Patent: Aug. 25, 2020

(54) ANTENNA STRUCTURE AND ELECTRONIC DEVICE

(71) Applicant: PEGATRON CORPORATION, Taipei (TW)

(72) Inventors: Chien-Yi Wu, Taipei (TW); Chao-Hsu Wu, Taipei (TW); Ching-Hsiang Ko, Taipei (TW); Shih-Keng Huang, Taipei (TW); Cheng-Hsiung Wu, Taipei (TW); Ya-Jyun Li, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 240 days.

(21) Appl. No.: 15/833,884

(22) Filed: Dec. 6, 2017

(65) Prior Publication Data

US 2018/0277925 A1 Sep. 27, 2018

(30) Foreign Application Priority Data

Mar. 24, 2017 (TW) ..... 106109884 A

(51) Int. Cl.
*H01Q 1/22* (2006.01)
*H01Q 9/04* (2006.01)
(Continued)

(52) U.S. Cl.
CPC ..... *H01Q 1/2266* (2013.01); *H01Q 1/2291* (2013.01); *H01Q 5/307* (2015.01);
(Continued)

(58) Field of Classification Search
CPC ..... H01Q 1/2258; H01Q 1/2266; H01Q 1/24; H01Q 1/241; H01Q 1/242; H01Q 1/243;
(Continued)

(56) References Cited

U.S. PATENT DOCUMENTS 5,677,698 A 10/1997 Snowdon
7,053,844 B2 * 5/2006 Gaucher ..... H01Q 9/0421 343/700 MS (Continued)

FOREIGN PATENT DOCUMENTS

TW M365554 9/2009
TW I518981 1/2016

*Primary Examiner* — Daniel Munoz
*Assistant Examiner* — Patrick R Holecek
(74) *Attorney, Agent, or Firm* — J.C. Patents

(57) ABSTRACT

An antenna structure including a grounding portion, a feeding portion, a first radiating portion, a second radiating portion, and a third radiating portion is provided. The first radiating portion is connected to the feeding portion, wherein the first radiating portion is adapted to generate a low-frequency resonant mode. The second radiating portion is connected to the feeding portion, wherein a first gap is formed between the first radiating portion and the second radiating portion, and the second radiating portion is adapted to generate a first high-frequency resonant mode. The third radiating portion is connected to the feeding portion, wherein a second gap is formed between the third radiating portion and the grounding portion, and the third radiating portion is adapted to generate a second high-frequency resonant mode. In addition, an electronic device including the antenna structure is also provided.

18 Claims, 6 Drawing Sheets

(51) Int. Cl.

| | |
|---|---|
| ***H01Q 9/42*** | (2006.01) |
| ***H01Q 5/307*** | (2015.01) |
| ***H01Q 5/371*** | (2015.01) |
| ***H01Q 21/06*** | (2006.01) |

(52) U.S. Cl.
CPC ..... *H01Q 5/371* (2015.01); *H01Q 9/0421* (2013.01); *H01Q 9/42* (2013.01); *H01Q 21/065* (2013.01)

(58) Field of Classification Search
CPC H01Q 1/48; H01Q 5/30; H01Q 5/307; H01Q 5/357; H01Q 5/364; H01Q 5/371; H01Q 9/0421; H01Q 21/065; H01Q 21/28
See application file for complete search history.

(56) References Cited

U.S. PATENT DOCUMENTS

| | | | | |
|---|---|---|---|---|
| 7,148,849 | B2 * | 12/2006 | Lin ..... | H01Q 1/243 343/700 MS |
| 8,325,096 | B2 | 12/2012 | Ayala Vazquez et al. | |
| 8,896,487 | B2 * | 11/2014 | Chiang ..... | G06F 1/1616 343/700 MS |
| 2008/0007461 | A1 | 1/2008 | Su et al. | |

* cited by examiner

ANTENNA STRUCTURE AND ELECTRONIC DEVICE

CROSS-REFERENCE TO RELATED APPLICATION

This application claims the priority benefit of Taiwan application serial no. 106109884, filed on Mar. 24, 2017. The entirety of the above-mentioned patent application is hereby incorporated by reference herein and made a part of this specification.

BACKGROUND

Field of the Invention

The invention relates to an antenna structure and an electronic device including the same, and in particular, to an antenna structure including a plurality of radiating portions and an electronic device including the same.

Description of Related Art

With the advance of technologies, the modes of communications for the general public have gradually become wireless. For example, smartphones, tablet computers, and laptops having wireless networking functions all fall in the scope of wireless communication, and wireless communication usually requires antennas for transmitting signals.

In terms of laptops, the housing is commonly formed of a metallic material to satisfy consumers' demand for a metal textured appearance of the product. The metal housing shields the antenna of the laptop and influences its capacity of signal reception and transmission. Therefore, the back cover of the display of some laptops is partially provided with a plastic housing, and the antenna disposed on the display is aligned with the plastic housing. However, such configuration influences the appearance of the laptop. Moreover, in some laptops, one single antenna structure is designed to include a plurality of radiating portions to generate resonant modes of multiple different frequencies. However, the plurality of radiating portions are generally sequentially extended in a continuous manner, which causes an overall extension length of the antenna structure to be overly large and occupies more configurational space inside the laptop. Therefore, how to configure the antenna structure to exhibit excellent capacity of signal reception and transmission without influencing the appearance of the laptop and save the configurational space of the antenna structure is one of the important issues in designing an antenna of laptops.

SUMMARY

The invention provides an antenna structure and an electronic device including the same capable of saving configurational space of the antenna structure.

The antenna structure of the invention includes a grounding portion, a feeding portion, a first radiating portion, a second radiating portion, and a third radiating portion. The first radiating portion is connected to the feeding portion, wherein the first radiating portion is adapted to generate a low-frequency resonant mode. The second radiating portion is connected to the feeding portion, wherein a first gap is formed between the first radiating portion and the second radiating portion, and the second radiating portion is adapted to generate a first high-frequency resonant mode. The third radiating portion is connected to the feeding portion, wherein a second gap is formed between the third radiating portion and the grounding portion, and the third radiating portion is adapted to generate a second high-frequency resonant mode.

The electronic device of the invention includes a device body and an antenna structure. The device body includes a housing, wherein the housing includes a sidewall. The antenna structure is disposed at the sidewall and is located in the housing, wherein the antenna structure includes a grounding portion, a feeding portion, a first radiating portion, a second radiating portion, and a third radiating portion. The first radiating portion is connected to the feeding portion, wherein the first radiating portion is adapted to generate a low-frequency resonant mode. The second radiating portion is connected to the feeding portion, wherein a first gap is formed between the first radiating portion and the second radiating portion, and the second radiating portion is adapted to generate a first high-frequency resonant mode. The third radiating portion is connected to the feeding portion, wherein a second gap is formed between the third radiating portion and the grounding portion, and the third radiating portion is adapted to generate a second high-frequency resonant mode.

In an embodiment of the invention, the first radiating portion and the second radiating portion are extended towards a first direction, the third radiating portion is extended towards a second direction, and the first direction is reverse to the second direction.

In an embodiment of the invention, the grounding portion is connected to a grounding plane of the housing, and a third gap is formed between the second radiating portion and the grounding plane of the housing.

In an embodiment of the invention, the grounding portion, the feeding portion, and the first radiating portion form a first planar inverted-F antenna (PIFA), the grounding portion, the feeding portion, and the second radiating portion form a second planar inverted-F antenna, and the grounding portion, the feeding portion, and the third radiating portion form a third planar inverted-F antenna.

In an embodiment of the invention, a frequency of the low-frequency resonant mode is adapted to be adjusted by changing a length of the first radiating portion, a width of the first radiating portion, or a width of the first gap, a frequency of the first high-frequency resonant mode is adapted to be adjusted by changing a length of the second radiating portion, a width of the second radiating portion, or a width of the third gap, and a frequency of the second high-frequency resonant mode is adapted to be adjusted by changing a length of the third radiating portion, a width of the third radiating portion, or a width of the second gap.

In an embodiment of the invention, a frequency of the low-frequency resonant mode is 2400 to 2500 MHz, a frequency of the first high-frequency resonant mode is 5470 to 5875 MHz, and a frequency of the second high-frequency resonant mode is 5150 to 5350 MHz.

In an embodiment of the invention, the housing includes an opening at the sidewall, a material of the housing includes metals, the electronic device includes an insulating cover covering the opening, and the antenna structure is disposed at the insulating cover.

In an embodiment of the invention, the electronic device includes a grounding component connected between the grounding portion and the housing.

In an embodiment of the invention, a third gap is formed between the second radiating portion and the grounding component.

In an embodiment of the invention, the electronic device includes a metal blocking wall, wherein the metal blocking wall is located in the housing, and the antenna structure is located between the insulating cover and the metal blocking wall.

In an embodiment of the invention, the electronic device includes an electronic component, wherein the electronic component is disposed in the housing, and the metal blocking wall is located between the electronic component and the antenna structure.

In an embodiment of the invention, the electronic device includes a speaker, wherein the speaker is disposed in the housing and is adjacent to the antenna structure, and the insulating cover covers the speaker.

In an embodiment of the invention, the housing includes a top wall, and the sidewall is inclinedly extended from an edge of the top wall to below the top wall.

In an embodiment of the invention, the insulating cover is extended to a bottom portion of the housing.

In light of the above, by forming the one single grounding portion, the one single feeding portion, and the three radiating portions (i.e., the first radiating portion, the second radiating portion, and the third radiating portion) of the antenna structure of the invention into the three antennas that are integrated, the configurational space of the antenna structure can be saved. In addition, the gaps (i.e., the first gap and the second gap) are formed respectively between the first radiating portion and the second radiating portion and between the third radiating portion and the grounding portion. Accordingly, it is understood that the first radiating portion, the second radiating portion, and the third radiating portion are respectively independently extended rather than being sequentially extended in a continuous manner, so that an overall extension length of the antenna structure is prevented from being overly large due to sequential and continuous extension of the radiating portions. As a result, the configurational space of the antenna structure can be further saved.

To provide a further understanding of the aforementioned and other features and advantages of the disclosure, exemplary embodiments, together with the reference drawings, are described in detail below.

DESCRIPTION OF THE EMBODIMENTS

Figure 1:
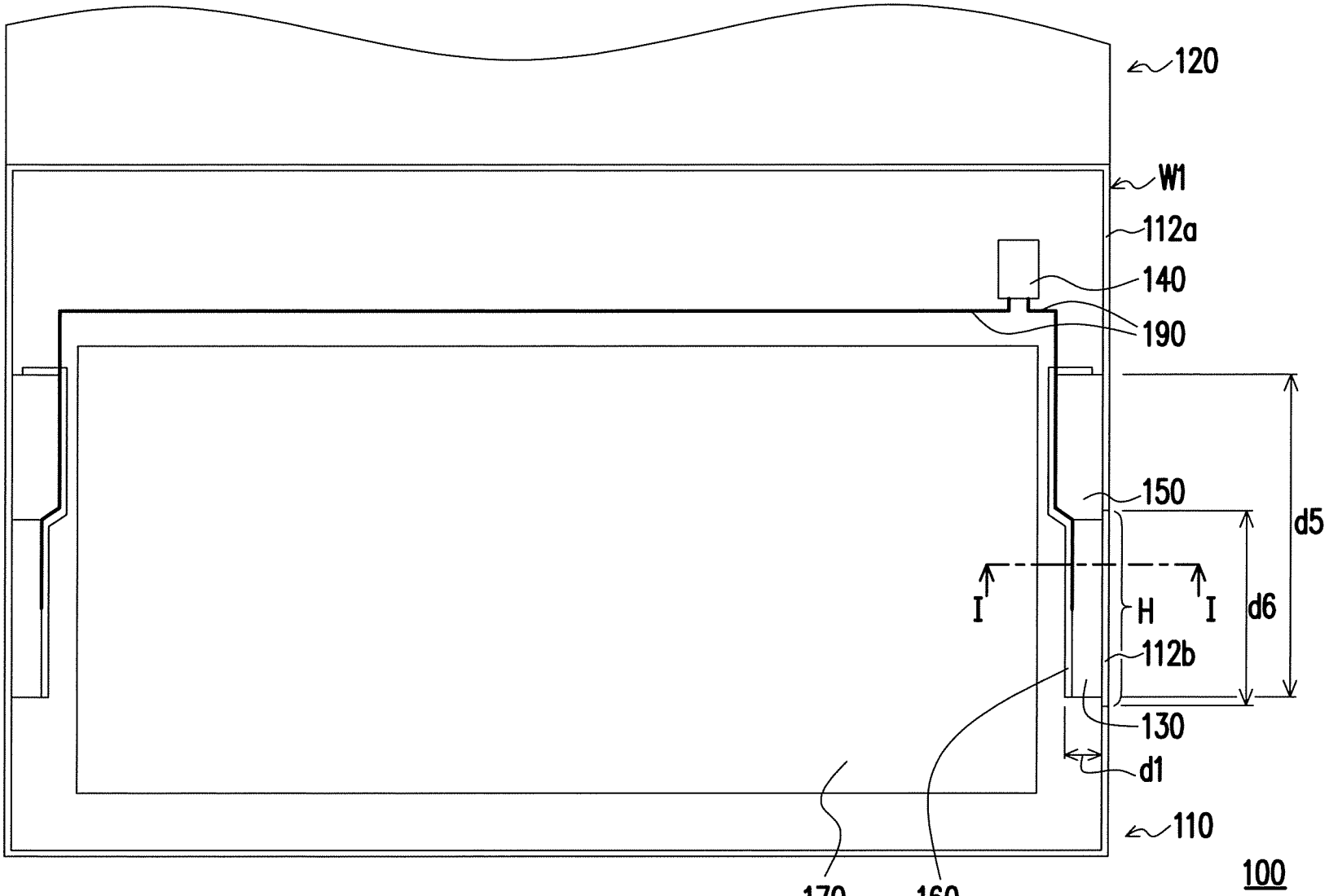
FIG. 1 is a schematic diagram illustrating part of components of an electronic device according to an embodiment of the invention.
Figure 2:
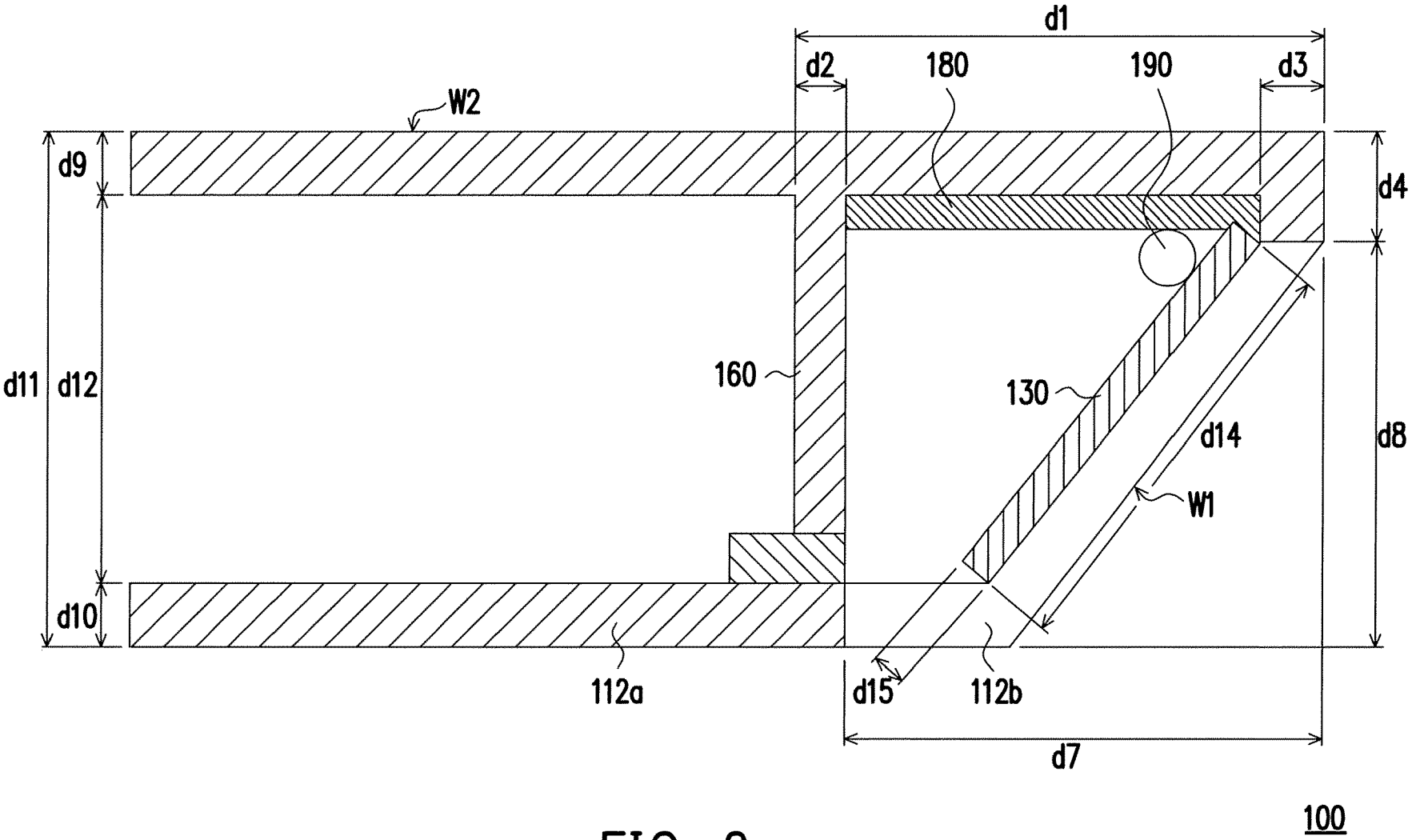
FIG. 2 is a cross-sectional diagram illustrating part of components of the electronic device of FIG. 1 along line I-I.

FIG. 1 is a schematic diagram illustrating part of components of an electronic device according to an embodiment of the invention. FIG. 2 is a cross-sectional diagram illustrating part of components of the electronic device of FIG. 1 along line I-I. Referring to FIG. 1 and FIG. 2, an electronic device 100 of the present embodiment is, for example, a laptop and includes a device body 110, a display 120, at least one antenna structure 130 (two antenna structures are illustrated), and a wireless signal processing module 140. As shown in FIG. 1, the antenna structure 130 of the present embodiment is illustrated as two antenna structures, and the two antenna structures 130 are respectively disposed at two opposite sides of the device body 110. However, the invention is not limited hereto, and it is also possible to dispose only one antenna structure 130 at the device body 110.

The device body 110 is, for example, a host of the laptop and includes a housing 112*a*, and the housing 112*a* includes a sidewall W1. The display 120 is, for example, a display of the laptop, is connected to the device body 110, and is adapted to unfold or close relatively to the device body 110. The antenna structure 130 is disposed on the sidewall W1 and is located in the housing 112*a*. The wireless signal processing module 140 is, for example, a WIFI module and is disposed in the housing 112*a*. The antenna structure 130 is electrically connected to the wireless signal processing module 140 via a connecting line 190 to perform reception and transmission of wireless signals.

In the present embodiment, the housing 112*a* includes an opening H (labeled in FIG. 1) on the sidewall W1, and a material of the housing 112*a* includes metals. The electronic device 100 includes an insulating cover 112*b*. The insulating cover 112*b* covers the opening H, and the antenna structure 130 is disposed on the insulating cover 112*b*. The antenna structure 130 is covered by the insulating cover 112*b* made of a non-metallic material to prevent a capacity of signal reception and transmission of the antenna structure 130 from being reduced due to shielding by metal. Moreover, with the antenna structure 130 disposed on the sidewall W1 of the device body 110 as described above, the insulating cover 112*b* corresponding to the antenna structure 130 can be located on the sidewall W1 and its influence on the appearance of the electronic device 100 can be reduced.

More specifically, the electronic device 100 of the present embodiment, as shown in FIG. 1, includes a speaker 150, and the speaker 150 is disposed in the housing 112*a* and is adjacent to the antenna structure 130. In other embodiments, in addition to covering the antenna structure 130, the insulating cover 112*b* may be further used to shield the speaker 150. In other words, an existing insulating external cover of the speaker 150 is extended to form the insulating cover 112*b*, such that an insulating structure corresponding to the antenna structure 130 is integrated with the insulating external cover of the speaker 150 so as to further reduce the influence caused by the insulating structure on the appearance of the electronic device 100.

Moreover, the housing 112*a* of the present embodiment, as shown in FIG. 2, includes a top wall W2. The sidewall W1 is inclinedly extended from an edge of the top wall W2 to below the top wall W2 so that the insulating cover 112*b* on the sidewall W1 is more visually concealed. In the present embodiment, the insulating cover 112*b* is, for example, extended to a bottom portion of the housing 112*a* to further reduce shielding of the antenna structure 130 by the metal housing 112*a*.

Referring to FIG. 1 and FIG. 2, the electronic device 100 of the present embodiment includes a metal blocking wall 160 and an electronic component 170 (illustrated in FIG. 1). The electronic component 170 is, for example, a battery and is disposed in the housing 112*a*, and the metal blocking wall 160 is located in the housing 112*a*. The antenna structure 130 is located between the insulating cover 112*b* and the metal blocking wall 160, and the metal blocking wall 160 is located between the electronic component 170 and the antenna structure 130. Accordingly, shielding by the metal blocking wall 160 prevents the electronic component 170 from generating interference with the antenna structure 130, or blocks noise signals generated by a motherboard (not illustrated in the drawings) disposed in the housing 112*a*, so that the antenna structure 130 can normally receive and transmit signals.

Figure 3:
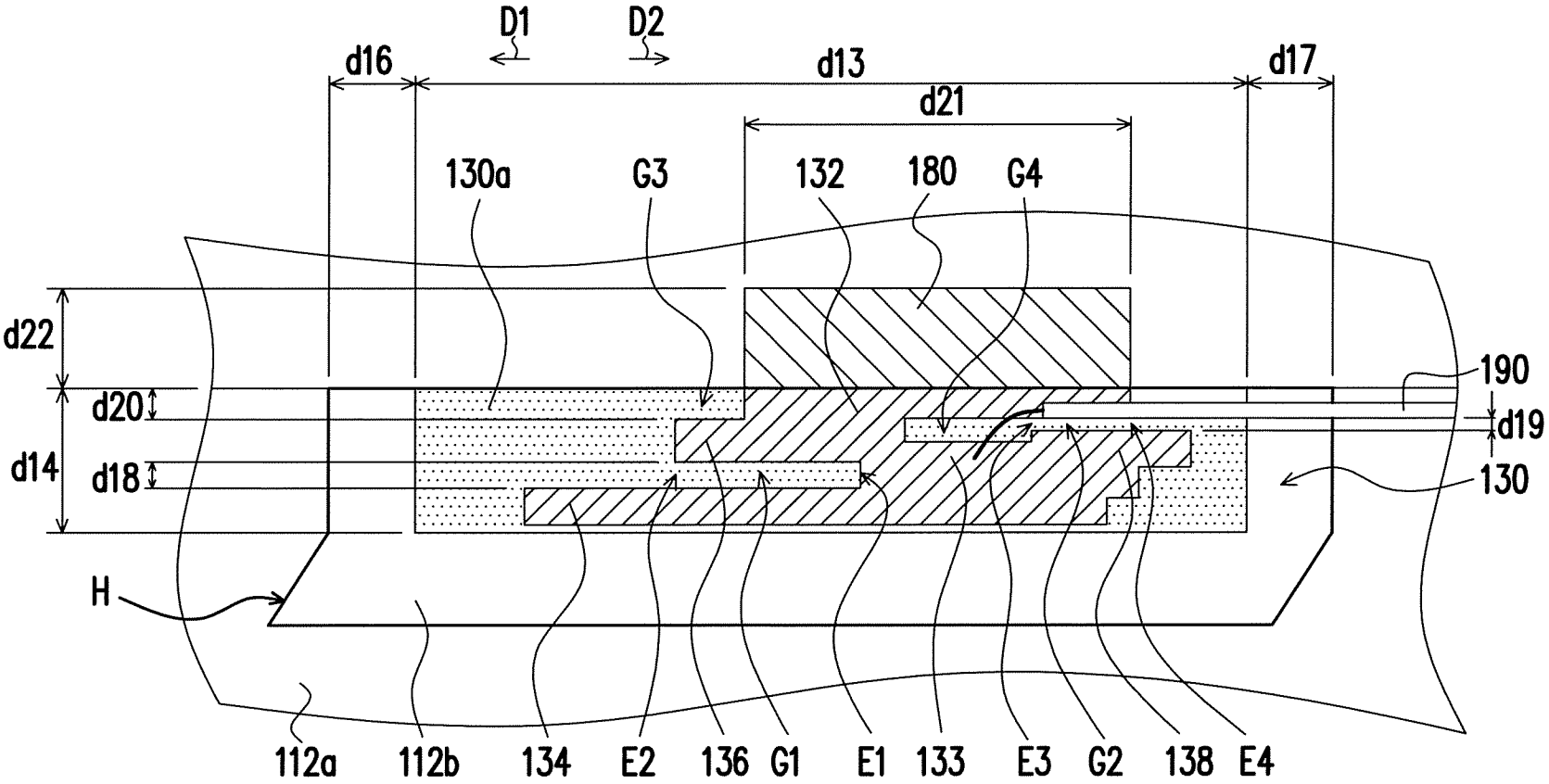
FIG. 3 is a partial schematic diagram illustrating the electronic device of FIG. 1.

A structural design of the antenna structure 130 of the present embodiment is described below with reference to the drawings. FIG. 3 is a partial schematic diagram illustrating the electronic device of FIG. 1. Referring to FIG. 3, the antenna structure 130 of the present embodiment includes a grounding portion 132, a feeding portion 133, a first radiating portion 134, a second radiating portion 136, and a third radiating portion 138 and is formed, for example, on an antenna substrate 130*a*. The first radiating portion 134, the second radiating portion 136, and the third radiating portion 138 are connected to the grounding portion 132, and the feeding portion 133 is connected among the first radiating portion 134, the second radiating portion 136, and the third radiating portion 138. The grounding portion 132, the feeding portion 133, and the first radiating portion 134, for example, form a first planar inverted-F antenna of a low-frequency resonant mode (WIFI 2.4G, with a frequency at about 2400 to 2500 MHz). The grounding portion 132, the feeding portion 133, and the second radiating portion 136, for example, form a second planar inverted-F antenna of a first high-frequency resonant mode (WIFI 5G, with a frequency at about 5470 to 5875 MHz). The grounding portion 132, the feeding portion 133, and the third radiating portion 138, for example, form a third planar inverted-F antenna of a second high-frequency resonant mode (WIFI 5G, with a frequency at about 5150 to 5350 MHz). By forming the one single grounding portion 132, the one single feeding portion 133, and the three radiating portions (i.e., the first radiating portion 134, the second radiating portion 136, and the third radiating portion 138) of the antenna structure 130 into the three planar inverted-F antennas that are integrated, configurational space of the antenna structure 130 can be saved.

Moreover, in the present embodiment, a first gap G1 is formed between the first radiating portion 134 and the second radiating portion 136, and a second gap G2 is formed between the third radiating portion 138 and the grounding portion 132. Accordingly, it is understood that the first radiating portion 134, the second radiating portion 136, and the third radiating portion 138 are not sequentially extended in a continuous manner, but are respectively independently extended from the feeding portion 133, so that an overall extension length of the antenna structure 130 is prevented from being overly large due to sequential and continuous extension of the radiating portions. As a result, the configurational space of the antenna structure 130 can be further saved.

The specific structure of the antenna structure 130 of the present embodiment will be described in greater detail below. Referring to FIG. 3, the second radiating portion 136 is directly connected to the grounding portion 132. The first radiating portion 134 is connected to the grounding portion 132 through the feeding portion 133 and the second radiating portion 136. The third radiating portion 138 is in a stepped shape and is connected to the grounding portion 132 through the feeding portion 133 and the second radiating portion 136. The first gap G1 between the first radiating portion 134 and the second radiating portion 136 has a first closed end E1 and a first open end E2 opposite to each other. The second gap G2 between the third radiating portion 138 and the grounding portion 132 has a second closed end E3 and a second open end E4 opposite to each other.

The first radiating portion 134 and the second radiating portion 136 are extended towards a first direction D1, and the third radiating portion 138 is extended towards a second direction D2 reverse to the first direction D1. In other words, the first radiating portion 134 and the second radiating portion 136 are parallel to each other, and an extension direction of the first radiating portion 134 and the second radiating portion 136 is opposite to an extension direction of the third radiating portion 138. Correspondingly, the first closed end E1 and the second closed end E3 are located between the first open end E2 and the second open end E4.

Referring to FIG. 2 and FIG. 3, the electronic device 100 of the present embodiment includes a grounding component 180. The grounding component 180 is, for example, a copper foil and is connected between the grounding portion 132 of the antenna structure 130 and the housing 112*a*, such that the grounding portion 132 is conducted to a grounding plane of the housing 112*a* via the grounding component 180. Specifically, a third gap G3 is formed between the second radiating portion 136 and the grounding plane of the housing 112*a*. Moreover, the electronic device 100 includes a coaxial transmission line 190. A grounding line of the coaxial transmission line 190 is connected to the grounding portion 132, and a signal line of the coaxial transmission line 190 is connected to the feeding portion 133. In addition, a fourth gap G4 is formed between the feeding portion 133 and the grounding portion 132. The fourth gap G4 is connected to the second gap G2, and as shown in FIG. 3, a width of the fourth gap G4 is slightly greater than a width of the second gap G2.

As shown in FIG. 1 and FIG. 2, a distance d1 between the metal blocking wall 160 and an edge of the housing 112 may be 11.7 to 24 mm, and preferably 12 mm, so that the metal blocking wall 160 does not generate interference with the antenna structure 130 because of being overly close to the antenna structure 130. Moreover, a thickness d2 (labeled in FIG. 2) of the metal blocking wall 160 may be 1.7 to 4 mm, and preferably 2 mm. A length d5 (labeled in FIG. 1) of the metal blocking wall 160 may be 80 to 180 mm, and preferably 90 mm. Thicknesses d3, d4 (labeled in FIG. 2) of the metal housing 112*a* may be 1 to 3 mm, and preferably 1.5 mm. A thickness d11 (labeled in FIG. 2) of the device body 110 may be 5 to 12 mm, and preferably 5.9 mm. A height d12 (labeled in FIG. 2) of an internal space of the device body 110 may be 4 to 10 mm, and preferably 4.7 mm. Thicknesses d9, d10 (labeled in FIG. 2) of the metal housing 112*a* may be 0.3 to 1.2 mm, and preferably 0.6 mm. A length d6 (labeled in FIG. 1) of the opening H may be 49 to 100 mm, and preferably 50 mm. A width d7 (labeled in FIG. 2) of the opening H may be 9.7 to 20 mm, and preferably 10 mm. A height d8 (labeled in FIG. 2) of the opening H may be 4 to 9 mm, and preferably 4.4 mm. A length d13 (labeled in FIG. 3) of the antenna substrate 130*a* may be 39 to 80 mm, and preferably 40 mm. A width d14 (labeled in FIG. 2 and FIG. 3) of the antenna substrate 130*a* may be 6 to 14 mm, and preferably 7 mm. A thickness d15 (labeled in FIG. 2) of the antenna substrate 130*a* may be 0.1 to 0.4 mm, and preferably 0.2 mm. Distances d16, d17 (labeled in FIG. 3) between the antenna substrate 130*a* and an inner edge of the opening H may be 4 to 10 mm, and preferably 5 mm. A width d18 (labeled in FIG. 3) of the first gap G1 may be 0.7 to 2 mm, and preferably 1 mm. A width d19 (labeled in FIG. 3) of the second gap G2 may be 0.2 to 1 mm, and preferably 0.5 mm. A width d20 (labeled in FIG. 3) of the third gap G3 may be 1 to 3 mm, and preferably 1.5 mm. A length d21

(labeled in FIG. 3) of the grounding component 180 may be 17 to 36 mm, and preferably 18 mm. A width d22 (labeled in FIG. 3) of the grounding component 180 may be 9 to 20 mm, and preferably 10 mm.

The specific sizes of the components of the present embodiment listed above are only examples and are not meant to limit the invention. They may be adjusted according to the needs. For example, an area of the metal blocking wall 160 may be adjusted to an adequate size to form a resonance chamber corresponding to the 5G frequency between the metal blocking wall 160 and the insulating cover 112*b* to thereby enhance the capacity of signal reception and transmission of the antenna structure 130. Moreover, the frequency point position or bandwidth of the first planar inverted-F antenna (i.e., the low-frequency resonant mode) may be adjusted by changing the length or the width of the first radiating portion 134 or the width of the first gap G1. The frequency point position or bandwidth of the second planar inverted-F antenna (i.e., the first high-frequency resonant mode) may be adjusted by changing the length or the width of the second radiating portion 136 or the width of the third gap G3. The frequency point position or bandwidth of the third planar inverted-F antenna (i.e., the second high-frequency resonant mode) may be adjusted by changing the length or the width of the third radiating portion 138 or the width of the second gap G2.

Figure 4:
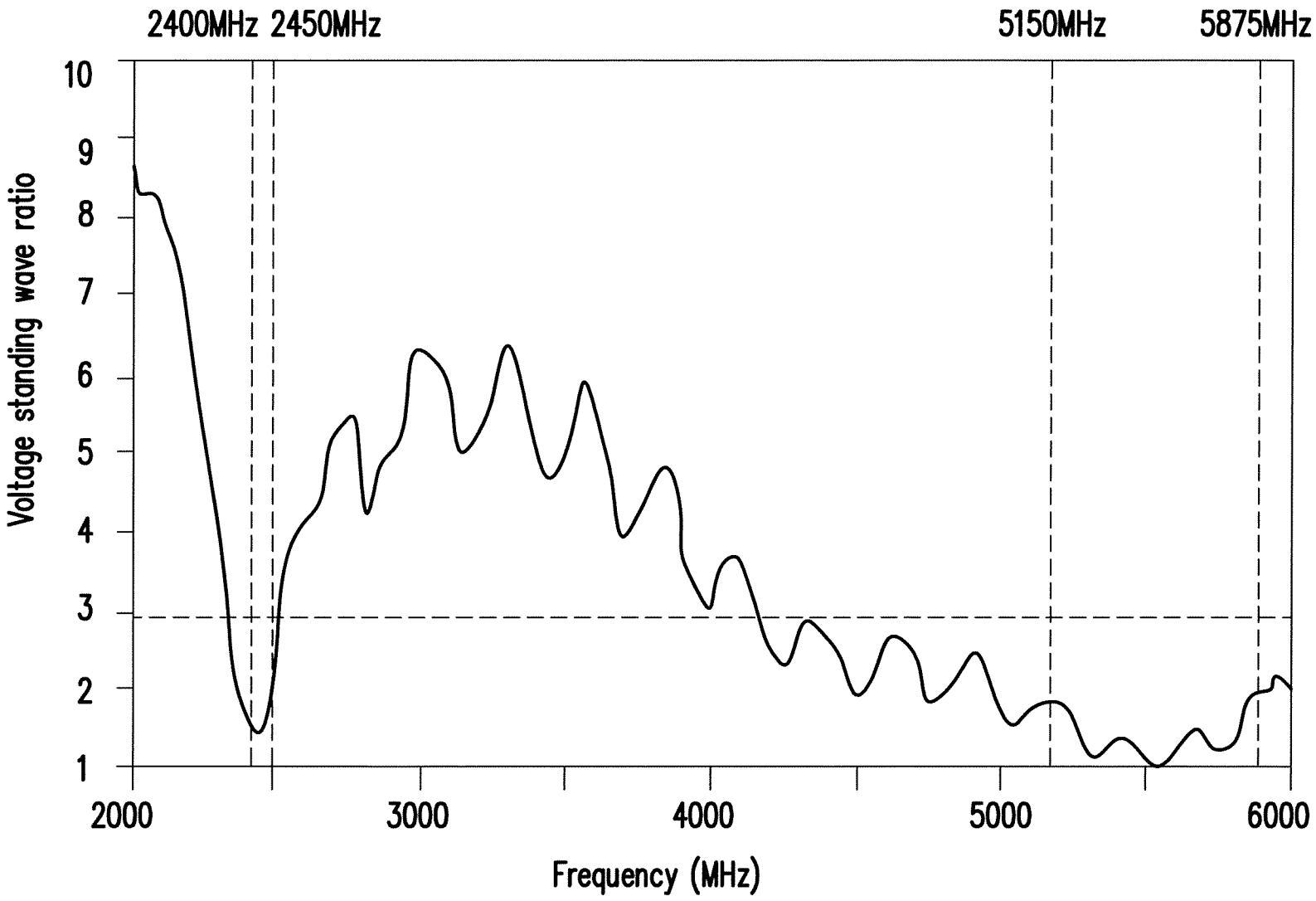
FIG. 4 illustrates a voltage standing wave ratio of the antenna structure of FIG. 3.

FIG. 4 illustrates a voltage standing wave ratio (VSWR) of the antenna structure of FIG. 3. In FIG. 4, frequency 2400 to 2500 MHz corresponds to the first planar inverted-F antenna, frequency 5150 to 5875 MHz corresponds to the second planar inverted-F antenna and the third planar inverted-F antenna, wherein the second planar inverted-F antenna is 5470 to 5875 MHz, and the third planar inverted-F antenna is 5150 to 5350 MHz. As shown in FIG. 4, the first planar inverted-F antenna, the second planar inverted-F antenna, and the third planar inverted-F antenna all have voltage standing wave ratios smaller than 3 and thus exhibit excellent voltage standing wave ratios.

Figure 5:
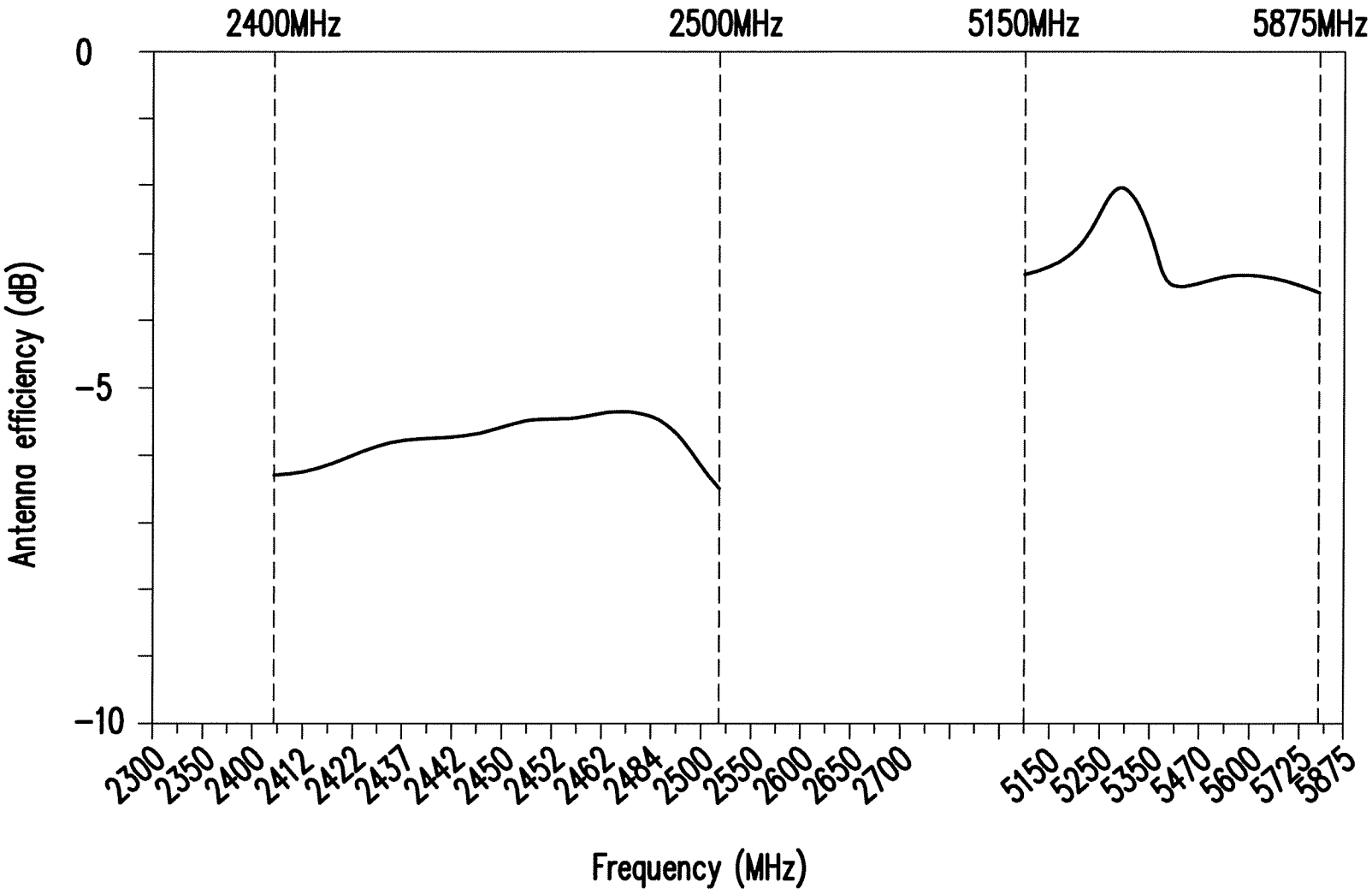
FIG. 5 illustrates an antenna efficiency of the antenna structure of FIG. 3.

FIG. 5 illustrates an antenna efficiency of the antenna structure of FIG. 3. As shown in FIG. 5, frequency 2400 to 2500 MHz corresponds to the first planar inverted-F antenna, frequency 5150 to 5875 MHz corresponds to the second planar inverted-F antenna and the third planar inverted-F antenna, wherein the second planar inverted-F antenna is 5470 to 5875 MHz, and the third planar inverted-F antenna is 5150 to 5350 MHz. As shown in FIG. 5, the first planar inverted-F antenna, the second planar inverted-F antenna, and the third planar inverted-F antenna all exhibit excellent antenna efficiencies.

Figure 6:
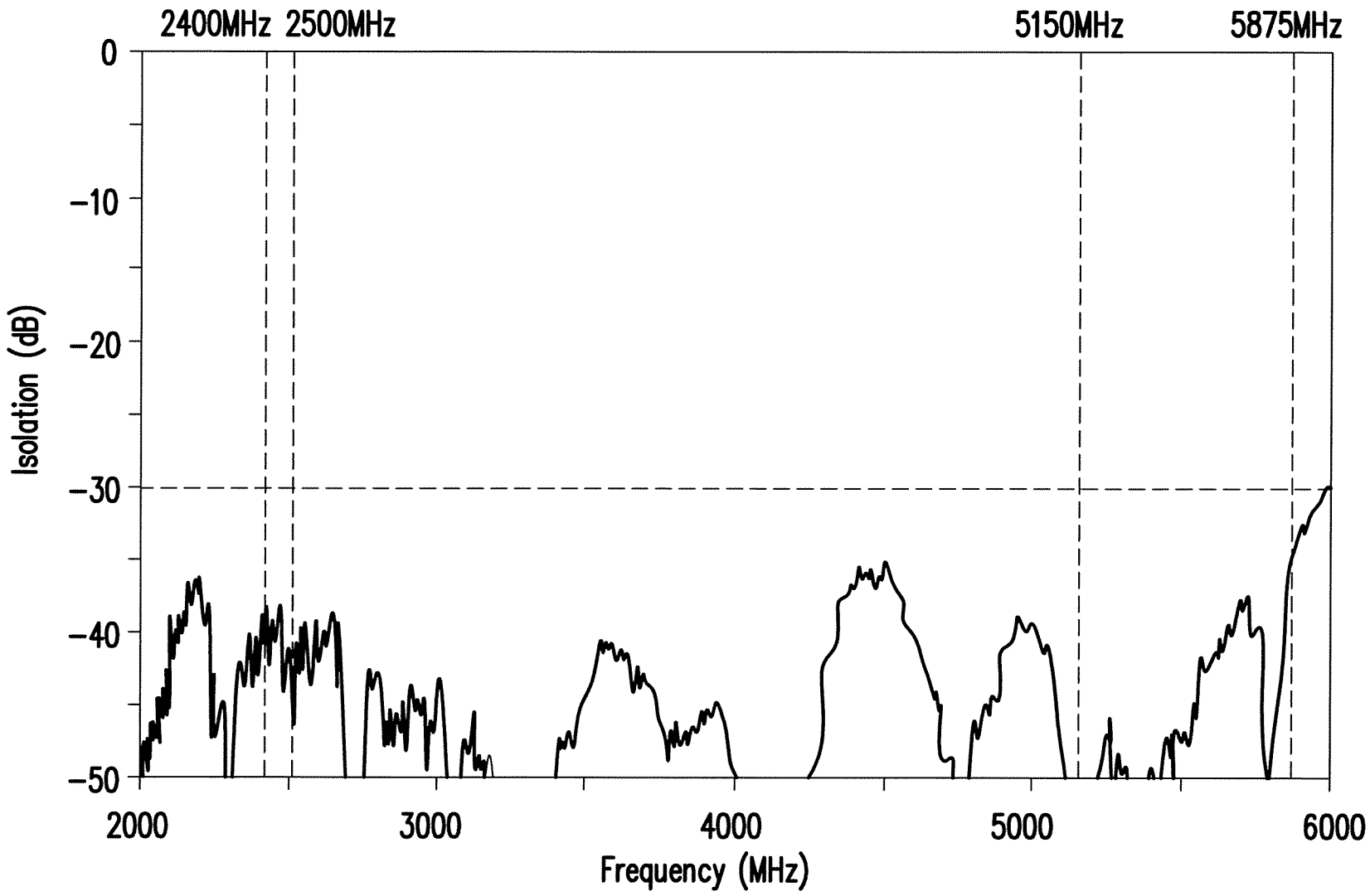
FIG. 6 illustrates an isolation of the antenna structure of FIG. 3.

FIG. 6 illustrates an isolation of the antenna structure of FIG. 3. As shown in FIG. 6, frequency 2400 to 2500 MHz corresponds to the first planar inverted-F antenna, frequency 5150 to 5875 MHz corresponds to the second planar inverted-F antenna and the third planar inverted-F antenna, wherein the second planar inverted-F antenna is 5470 to 5875 MHz, and the third planar inverted-F antenna is 5150 to 5350 MHz. As shown in FIG. 6, the first planar inverted-F antenna, the second planar inverted-F antenna, and the third planar inverted-F antenna all have isolations smaller than −30 dB and thus exhibit excellent isolations.

In summary of the above, in the electronic device of the invention, with the antenna structure disposed on the sidewall of the device body, the insulating cover corresponding to the antenna structure can be located on the sidewall and its influence on the appearance of the electronic device can be reduced. Moreover, by forming the one single grounding portion, the one single feeding portion, and the three radiating portions (i.e., the first radiating portion, the second radiating portion, and the third radiating portion) of the antenna structure into the three planar inverted-F antennas that are integrated, the configurational space of the antenna structure can be saved. In addition, in the antenna structure, the gaps (i.e., the first gap and the second gap) are formed respectively between the first radiating portion and the second radiating portion and between the third radiating portion and the grounding portion. Accordingly, it is understood that the first radiating portion, the second radiating portion, and the third radiating portion are respectively independently extended rather than being sequentially extended in a continuous manner, so that the overall extension length of the antenna structure is prevented from being overly large due to sequential and continuous extension of the radiating portions. As a result, the configurational space of the antenna structure can be further saved.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. An antenna structure comprising:

a grounding portion;

a feeding portion connected to the grounding portion;

a first radiating portion connected to the feeding portion and comprising a first free end, wherein the first radiating portion is adapted to generate a low-frequency resonant mode;

a second radiating portion connected to the feeding portion and comprising a second free end, wherein a first gap is formed between the first radiating portion and the second radiating portion, an extension direction of the first free end is parallel to an extension direction of the second free end, and the second radiating portion is adapted to generate a first high-frequency resonant mode; and a third radiating portion connected to the feeding portion, wherein a second gap is formed between the third radiating portion and the grounding portion, and the third radiating portion is adapted to generate a second high-frequency resonant mode, wherein the first radiating portion, the second radiating portion, and the third radiating portion are respectively independently extended from the feeding portion.

2. The antenna structure according to claim 1, wherein the extension direction of the first free end of the first radiating portion and the extension direction of the second free end of the second radiating portion are a first direction, an extension direction of a third free end of the third radiating portion is a second direction, and the first direction is reverse to the second direction.

3. The antenna structure according to claim 1, wherein the grounding portion is connected to a grounding plane of a housing, and a third gap is formed between the second radiating portion and the grounding plane of the housing.

4. The antenna structure according to claim 3, wherein the grounding portion, the feeding portion, and the first radiating portion form a first planar inverted-F antenna, the grounding portion, the feeding portion, and the second radiating portion form a second planar inverted-F antenna, and the grounding portion, the feeding portion, and the third radiating portion form a third planar inverted-F antenna.

5. The antenna structure according to claim 3, wherein a frequency of the low-frequency resonant mode is adapted to be adjusted by changing a length of the first radiating portion, a width of the first radiating portion, or a width of the first gap, a frequency of the first high-frequency resonant mode is adapted to be adjusted by changing a length of the second radiating portion, a width of the second radiating portion, or a width of the third gap, and a frequency of the second high-frequency resonant mode is adapted to be adjusted by changing a length of the third radiating portion, a width of the third radiating portion, or a width of the second gap.

6. The antenna structure according to claim 1, wherein a frequency of the low-frequency resonant mode is 2400 to 2500 MHz, a frequency of the first high-frequency resonant mode is 5470 to 5875 MHz, and a frequency of the second high-frequency resonant mode is 5150 to 5350 MHz.

7. An electronic device comprising:

a device body comprising a housing, wherein the housing comprises a sidewall; and an antenna structure disposed at the sidewall and located in the housing, wherein the antenna structure comprises:

a grounding portion;

a feeding portion connected to the grounding portion;

a first radiating portion connected to the feeding portion and comprising a first free end, wherein the first radiating portion is adapted to generate a low-frequency resonant mode;

a second radiating portion connected to the feeding portion and comprising a second free end, wherein a first gap is formed between the first radiating portion and the second radiating portion, an extension direction of the first free end is parallel to an extension direction of the second free end, and the second radiating portion is adapted to generate a first high-frequency resonant mode; and a third radiating portion connected to the feeding portion, wherein a second gap is formed between the third radiating portion and the grounding portion, and the third radiating portion is adapted to generate a second high-frequency resonant mode, wherein the first radiating portion, the second radiating portion, and the third radiating portion are respectively independently extended from the feeding portion.

8. The electronic device according to claim 7, wherein the extension direction of the first free end of the first radiating portion and the extension direction of the second free end of the second radiating portion are a first direction, an extension direction of a third free end of the third radiating portion is a second direction, and the first direction is reverse to the second direction.

9. The electronic device according to claim 7, wherein the grounding portion is connected to a grounding plane of the housing, and a third gap is formed between the second radiating portion and the grounding plane of the housing.

10. The electronic device according to claim 9, wherein the grounding portion, the feeding portion, and the first radiating portion form a first planar inverted-F antenna, the grounding portion, the feeding portion, and the second radiating portion form a second planar inverted-F antenna, and the grounding portion, the feeding portion, and the third radiating portion form a third planar inverted-F antenna.

11. The electronic device according to claim 9, wherein a frequency of the low-frequency resonant mode is adapted to be adjusted by changing a length of the first radiating portion, a width of the first radiating portion, or a width of the first gap, a frequency of the first high-frequency resonant mode is adapted to be adjusted by changing a length of the second radiating portion, a width of the second radiating portion, or a width of the third gap, and a frequency of the second high-frequency resonant mode is adapted to be adjusted by changing a length of the third radiating portion, a width of the third radiating portion, or a width of the second gap.

12. The electronic device according to claim 7, wherein the housing comprises an opening at the sidewall, a material of the housing comprises metals, the electronic device comprises an insulating cover covering the opening, and the antenna structure is disposed at the insulating cover.

13. The electronic device according to claim 12, comprising a metal blocking wall, wherein the metal blocking wall is located in the housing, and the antenna structure is located between the insulating cover and the metal blocking wall.

14. The electronic device according to claim 13, comprising an electronic component, wherein the electronic component is disposed in the housing, and the metal blocking wall is located between the electronic component and the antenna structure.

15. The electronic device according to claim 12, comprising a speaker, wherein the speaker is disposed in the housing and is adjacent to the antenna structure, and the insulating cover covers the speaker.

16. The electronic device according to claim 12, wherein the insulating cover is extended to a bottom portion of the housing.

17. The electronic device according to claim 7, wherein the housing comprises a top wall, and the sidewall is inclinedly extended from an edge of the top wall to below the top wall.

18. The electronic device according to claim 7, wherein a frequency of the low-frequency resonant mode is 2400 to 2500 MHz, a frequency of the first high-frequency resonant mode is 5470 to 5875 MHz, and a frequency of the second high-frequency resonant mode is 5150 to 5350 MHz.

* * * * *